US005579085A

United States Patent [19]

Miyabe et al.

[11] Patent Number: 5,579,085

[45] Date of Patent: Nov. 26, 1996

[54] IMAGE FORMING APPARATUS AND DETACHABLE PROCESS CARTRIDGE HAVING PRESS-FITTED FLANGE TO CYLINDER

[75] Inventors: Shigeo Miyabe; Hiroo Kobayashi; Kazuo Shishido, all of Yokohama; Koji Miura, Sagamihara, all of Japan

[73] Assignee: Canon Kabushiki Kaisha, Tokyo, Japan

[21] Appl. No.: 500,567

[22] Filed: Jul. 11, 1995

Related U.S. Application Data

[63] Continuation of Ser. No. 123,147, Sep. 17, 1993, abandoned.

[30] Foreign Application Priority Data

Sep. 21, 1992 [JP] Japan ..... 4-274854

[51] Int. Cl.[6] ..... G03G 15/00

[52] U.S. Cl. ..... 355/200; 355/211; 355/245

[58] Field of Search ..... 355/211, 245, 355/251, 259, 261, 200; 118/651, 656, 657, 658, 661; 492/17, 18, 27, 47; 29/469.5, 507, 512, 523, 525, 895.2, 895.22

[56] References Cited

U.S. PATENT DOCUMENTS

| | | | |
|---|---|---|---|
| 4,271,786 | 6/1981 | Buckley et al. | 118/661 |
| 4,527,883 | 7/1985 | Kamiyama | 355/211 |
| 4,561,763 | 12/1985 | Basch | 355/211 |
| 4,794,894 | 1/1989 | Gill | 29/525 |
| 4,839,690 | 6/1989 | Onoda et al. | 355/211 |
| 4,850,095 | 7/1989 | Akao et al. | 29/447 |
| 4,935,778 | 6/1990 | Mochida | 355/211 |
| 5,052,090 | 10/1991 | Kitaura et al. | 355/211 |
| 5,148,220 | 9/1992 | Hilbert et al. | 355/245 |
| 5,151,734 | 9/1992 | Tsuda et al. | 355/200 |
| 5,151,737 | 9/1992 | Johnson et al. | 355/211 |

*Primary Examiner*—Robert Beatty

*Attorney, Agent, or Firm*—Robin, Blecker, Daley & Driscoll

[57] ABSTRACT

An image forming apparatus is provided with a cylinder for carrying developing agent, and with a flange fitted into an end portion of the cylinder for supporting the cylinder. A fitting portion of the flange has a diameter larger than an inner diameter of the cylinder. The flange is mounted to the cylinder by press-fitting and has a guide smaller than the inner diameter of the cylinder at an end of the fitting portion for guiding the fitting. A spacer is located at a more central side of the cylinder than the fitting portion of the flange press-fitted into the cylinder.

56 Claims, 8 Drawing Sheets

IMAGE FORMING APPARATUS AND DETACHABLE PROCESS CARTRIDGE HAVING PRESS-FITTED FLANGE TO CYLINDER

This is a continuation application under 37 CFR 1.62 of prior application Ser. No. 08/123,147, filed Sept. 17, 1993, abandoned.

BACKGROUND OF THE INVENTION

1. Field of the Invention

The present invention relates to an image forming apparatus such as an electro-photographic copying machine or a laser beam printer, and more particularly to a system for supporting a photoconductor drum and a development sleeve.

2. Related Background Art

A conventional image forming apparatus is provided with a development roller including a development sleeve and a magnet roller, and a periphery of the development roller is constructed as shown in FIG. 7, in which numeral 101 denotes a photoconductor drum, numeral 102 denotes a photoconductor drum gear, numeral 103 denotes a development sleeve, numeral 104 denotes a development roller flange, numeral 105 denotes a magnet roller, numeral 106 denotes a holder, numeral 107 denotes a development roller bearing, numeral 108 denotes a development roller gear and numeral 109 denotes a spacer roll.

As shown in FIG. 7, the development sleeve 103 has the magnet roller 105 therein and it is supported by the development roller bearing 107 at the opposite ends. The development roller bearing 107 is positioned and fixed to the holder 106 by a positioning pin and a hole (both not shown). The magnet roller 105 is fitted to and held by the holder 106. A photoconductor 101*a* and a gear 102 are coupled by adhesive, and the photoconductor drum 101 is press-contacted with the development roller by the spring 110 through the spacer roll 109, which functions for keeping a constant spacing between the development roller and the photoconductor drum 101. The photoconductor drum 101 thus constructed receives a rotational driving force from the image forming apparatus main unit through the gear 102 and transmits the driving force to the development roller gear 108 to rotationally drive the development roller in a direction of an arrow.

In such an apparatus, the flange 104 is loosely fitted to an end of the development sleeve 103 as shown in FIG. 8 and they are coupled by adhesive 111. Specifically, the adhesive 111 is applied with a uniform thickness to the entire inner surface of the end of the development sleeve 103 into to which the flange 104 is to be inserted, and then the flange 104 is fitted thereto. Thereafter, it is preserved with keeping the temperature and the humidity constant until the adhesive is completely cured. The adhesive 111 primarily used is an instantaneous adhesive, or adhesive primer and anaerobic adhesive, and is selectively used depending on the application, the object and the required strength.

However, the prior art has the following problems.

Namely, when the bonding with adhesive is made under an environment of a high temperature and a high humidity and the adhesive is completely cured in that environment, water content contained in the air adversely affects the bonding surface during the curing, so that the bonding strength is lowered. As a result, there will arise a possibility that the development sleeve is separated from the flange or it is driven in idle. Thus, the quality of the bonding is unstable.

Further, depending on the type of adhesive, a very long time may be required before the bond is completely cured. For this reason, a space to maintain it during that period is necessary, also the facilities to keep the maintenance environment temperature and humidity is required. Thus, these are disadvantageous in the aspects of cost, management and productivity.

Further, the development sleeve 103 and the development roller flange 104 are loosely fitted with a clearance and when the clearance is offset as shown in FIG. 8, a center offset between the development sleeve 103 and the flange 104 is given by A as shown in FIG. 8. Under this condition, when the rotational driving force is imparted to the photoconductor drum 101, the development roller is rotated by the photoconductor drum gear 102 through the development roller gear 108, so that the outer diameter of the flange 104 is moved with the vibration which is twice as large as the dimension A with reference to the outer diameter of the development sleeve 103. Accordingly, with reference to the surface of the photoconductor drum 101, the magnet roller 105 is moved by twice the dimension A per revolution. As a result, when viewed from the photoconductor drum, a magnetic force of the magnet roller is enhanced or deenhanced, so that the irregularity of density occurs on the image at the rotation period of the development roller.

SUMMARY OF THE INVENTION

It is an object of the present invention to provide an image forming apparatus and a process cartridge, which are capable of coupling the flange to the cylinder.

It is another object of the present invention to provide an image forming apparatus and a process cartridge in which the flange is fitted to the cylinder by press insertion.

It is another object of the present invention to provide an image forming apparatus and a process cartridge, which are always capable of maintaining a constant spacing between the development sleeve and the photoconductor drum.

It is a further object of the present invention to provide an image forming apparatus and a process cartridge in which a spacer is provided axially of the cylinder at a position other than a fitting portion of the flange and the cylinder.

Other objects of the present invention will be apparent from the following description.

DETAILED DESCRIPTION OF THE PREFERRED EMBODIMENTS

An embodiment of the present invention is now explained with reference to the drawings.

Figure 1:
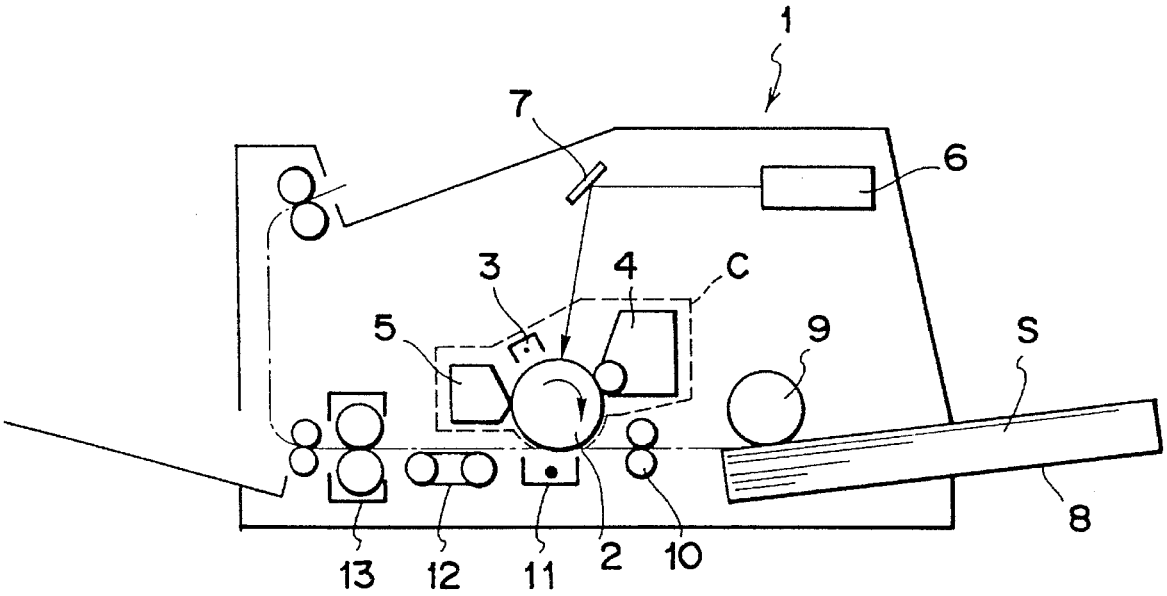
FIG. 1 shows a simplified sectional view of an image forming apparatus in accordance with the present invention.

FIG. 1 shows a simplified sectional view of an image forming apparatus in accordance with the present invention. In FIG. 1, the image forming apparatus 1 is provided with a photoconductor drum 2 which is an image carrier, and with known process equipment such as a charger 3, a development unit 4 and a cleaner 5, each arranged in the periphery of the photoconductor drum 2. A scanner unit 6 and a mirror 7 for irradiating and scanning a laser beam are arranged at the top of the apparatus main unit 1. A latent image corresponding to given image information is formed on the photoconductor drum 2 which is uniformly charged by the charger 3. The latent image is developed by the development unit 4 into a toner image. A sheet feed cassette 8 for accommodating a number of sheets S which are recording media, is arranged at the bottom of the apparatus main unit 1. A sheet feed roller 9 is arranged to face the sheet feed cassette 8 so that the sheet S accommodated in the sheet feed cassette 8 are fed by the sheet feed roller 9 to a regist roller 10 one by one. The timing of the sheet S is adjusted by the regist roller 10, and the sheet S is fed to a position between the photoconductor drum 1 and a transfer charger 11, and the toner image on the photoconductor drum 1 is transferred at that position. The sheet S having the toner image transferred thereon is fed to a fixing unit 13 by a conveyer belt unit 12, and the toner image thereon is fixed, thereafter, the sheet S is discharged from the apparatus main unit 1.

In the present apparatus, the photoconductor drum 2, the charger 3, the development unit 4 and the cleaner 5 are integrally constructed to form a process cartridge C.

Figure 2:
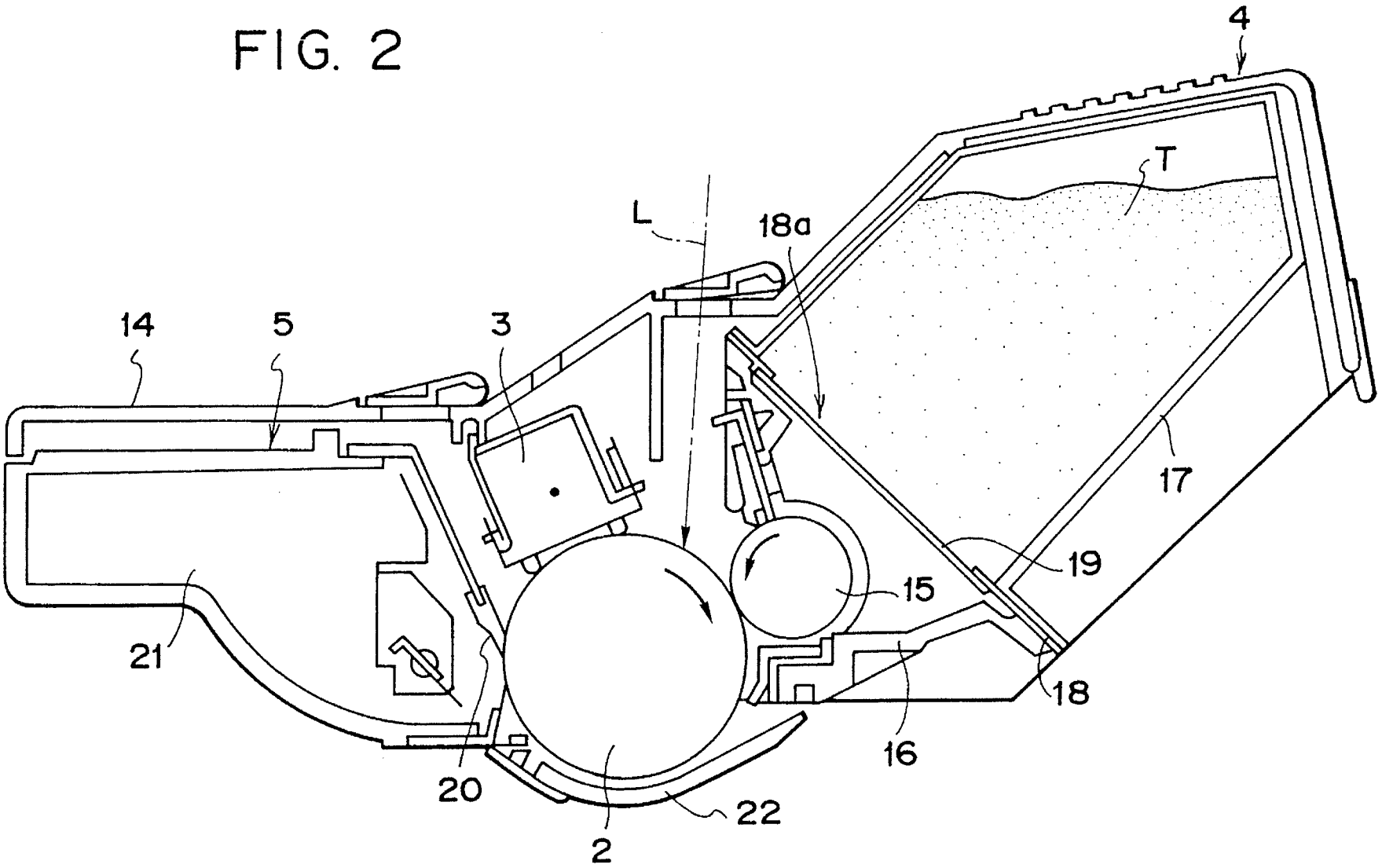
FIG. 2 shows a sectional view of a process cartridge of the apparatus of FIG. 1.

The process cartridge C is now explained. FIG. 2 shows a sectional view of the process cartridge C having the photoconductor drum formed by a cylinder member and the development roller constructed in accordance with the present invention. In FIG. 2, numeral 2 denotes the photoconductor drum which is an image carrier, rotating in a fixed direction. The process equipment such as the charger 3, the development unit 4 and the cleaning unit 5 are arranged around the photoconductor drum 2. This equipment is integrally incorporated in a cartridge container 14, which is detachably mounted within the main unit of the image forming apparatus as the process cartridge C. Thus, when, for example, the life of the photoconductor drum 2 expires or the toner (developing agent) in the development unit 4 is used up, the entire process cartridge is exchanged to thereby facilitate the maintenance.

The development unit 4 includes a development portion 16 having a development roller 15 which is a developing agent carrier facing the photoconductor drum 2, and a developing agent container 17 having toner T therein for supplying the toner T to the development portion 16. A cover member 18 having an opening 18*a* is interposed between the developer 16 and the developing agent container 17. A sealing device 19 to be described later is attached to the opening 18*a* of the cover member 18 to prevent the toner T in the developing agent container 17 from moving to the development portion 16 and flowing out of the process cartridge in the non-use state. When the process cartridge C is attached to the main unit of the image forming apparatus for use, the sealing device 19 is manipulated to open the opening 18*a*, so that the toner in the developing agent container 17 is supplied to the development portion 16.

The cleaning device 5 includes a cleaning blade 20 for frictionally contacting the photoconductor drum 2 to remove residual toner on the photoconductor drum 2, and an exhausted toner container 21 for containing exhausted toner removed by the cleaning blade 20. It is provided to clean the residual toner on the photoconductor drum 2 to prepare the photoconductor drum 2 for the next image formation.

Numeral 22 denotes a shutter for protecting the photoconductor drum 2. When the process cartridge C is attached in the main unit of the image forming apparatus, the shutter 22 is retracted to one side of the photoconductor drum.

In the present embodiment, when an image light L is exposed to the photoconductor drum uniformly charged by the charger 3 from the scanning optical system 6 (see FIG. 1), an electrostatic latent image is formed on the photoconductor drum 2. As the photoconductor drum 2 is rotated, the electrostatic latent image is sent to the development unit 4 and the toner T is supplied to the photoconductor drum 2 by the development roller 15 of the development unit 4, and the latent image is visualized as a toner image. The toner image is transferred to the recording medium by the transfer means 11 (see FIG. 1). After the transfer is finished, the residual toner on the photoconductor drum 2 is cleaned by the cleaning device 5 to prepare it for the next image formation.

The recording medium is fed to the photoconductor drum 2 from the sheet feed cassette 8 (see FIG. 1), and after the transfer of the toner image is made from the photoconductor drum 2, it is sent to the fixing unit 13 (see FIG. 1) and the toner image is fixed by the fixing unit.

Figure 3:
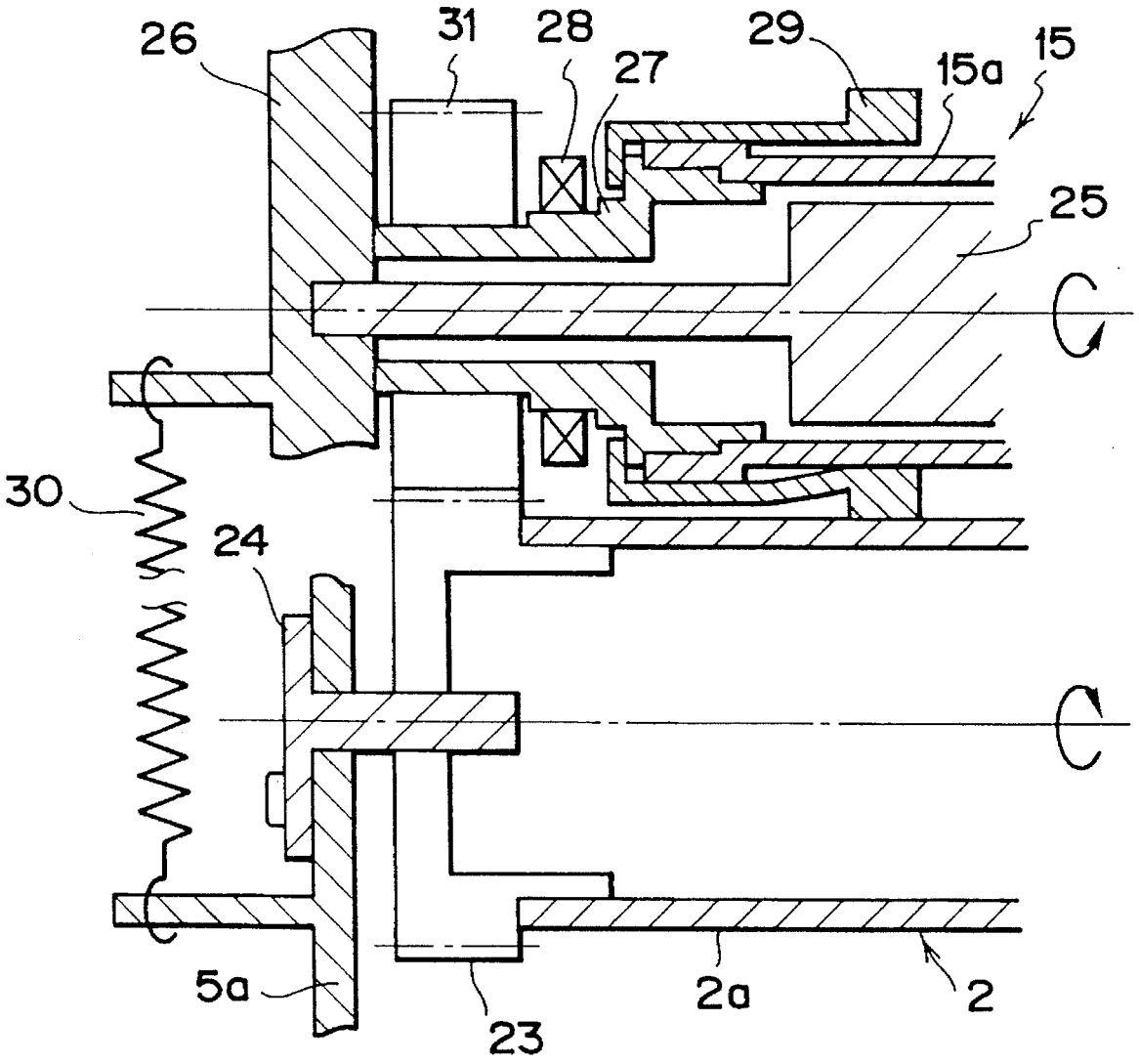
FIG. 3 shows a periphery of the development roller and the photoconductor drum in FIG. 2.

The process cartridge C of the present invention is explained in further detail with reference to FIG. 3.

The photoconductor drum 2 includes a pipe 2*a* and a gear flange 23, which are coupled to each other. The photoconductor drum 2 is rotatably supported to the cleaning container 5*a* by a centering shaft 24.

On the other hand, the development unit 4 includes a magnet roller 25 which is held to a magnet holder 26. The development roller 15 having the development sleeve 15*a* is rotatably held to the roller bearing 28 in the flange 27 thereof, and the roller bearing 28 is fixed to the magnet holder 26 by a positioning pin and a hole (both not shown). The magnet holder 26 is fixed to a developing container (not shown) by a screw. A cap-shaped spacer roll 29 made of resin is rotatably fitted to an end of the development roller 15 to keep the distance to the photoconductor drum 2 constant.

On the other hand, the cleaning container 5*a* is rotatably supported to the magnet holder 26 around a predetermined center of rotation (not shown) and it is further biased in one direction by a spring 30. As a result, the spacer roll 29 is press-contacted with a curved surface of the pipe 2*a* of the photoconductor drum 2 and a curved surface of the development sleeve 15*a*, whereby the development sleeve 15*a* and the pipe 2*a* of the photoconductor drum 2 are kept at the constant spacing. The rotating driving force is transmitted to the development roller gear 31 by a drive gear (not shown) of the main unit of the image forming apparatus through the gear flange 23 of the photoconductor drum 2, so that the photoconductor drum 2 and the development roller 15 are rotated in the directions of arrows as shown in FIG. 3, respectively.

Figure 4:
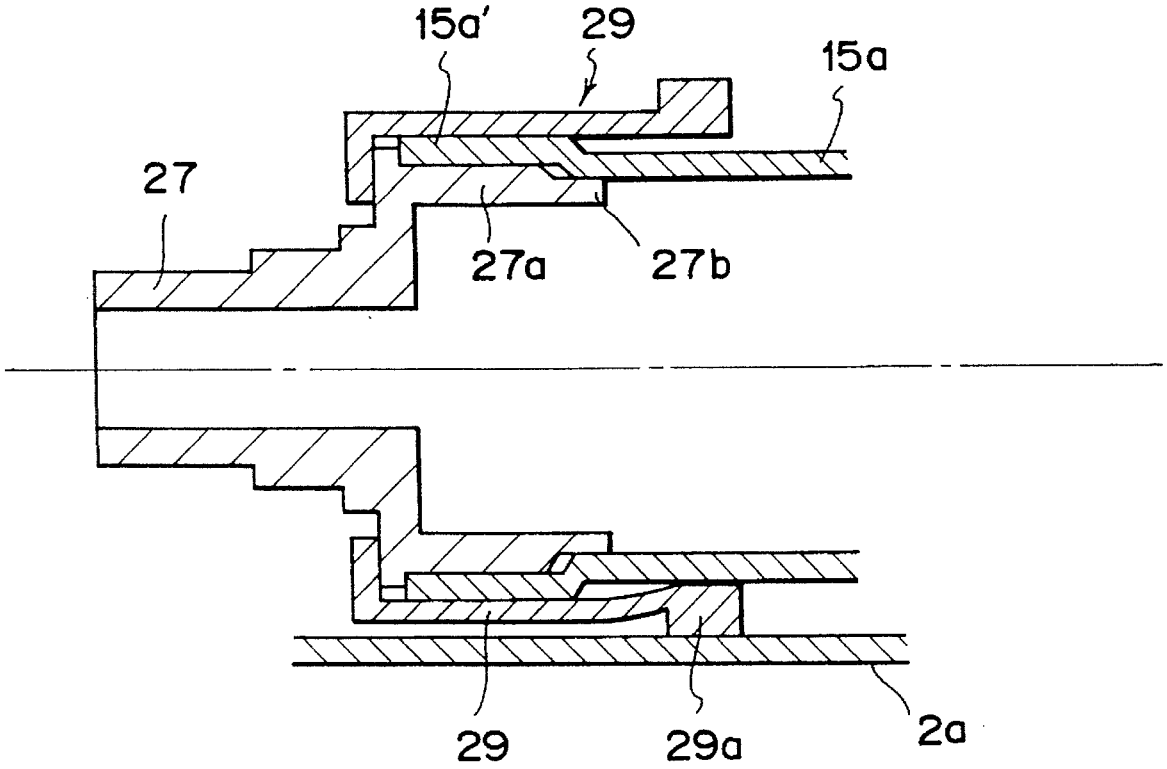
FIG. 4 shows a fitting portion of the development sleeve and the flange in FIG. 3.

The present embodiment is further explained with reference to FIG. 4. An outer diameter of the flange 27 of the development roller is approximately 100 μm larger than an inner diameter of the development sleeve 15*a*, and the flange 27 is press-fitted into the development sleeve 15*a*. The development sleeve 15*a* and the flange 27 are prevented from being idling rotation by a resilient force to return to the original positions. A guide 27*b* for guiding the fitting is provided at an end of the fitting portion 27*a* of the flange 27. An outer diameter of the guide 27*b* is approximately 10–90 μm smaller than the inner diameter of the development sleeve 15*a*, and when the flange 27 is press-fitted, the guide 27*b* fully acts as guide to the inner diameter of the development sleeve 15*a*, so that the flange 27 of the development roller is prevented from being inclined and fitted thereinto. As a result, the development roller 15 can be rotated without vibrating around the bearing 28 and the irregularity in the image is prevented.

In the present embodiment, since the development sleeve and the flange are tightly fitted without clearance, the flange and the development sleeve can be strongly coupled and the idling rotation between the flange and the development sleeve due to peel-off of the adhesive can be prevented.

Further, since the guide is provided in the flange, the development sleeve 15*a* which is inclined is prevented from being fitting into the flange 27 upon press fitting, and a high precision construction is attained. As a result, the axial centers of the respective units align, and they do not move with vibration as the conventional apparatus, and the position of the magnet roller 25 to the surface of the photoconductor drum 2 does not vary. Accordingly, the assembly method is economic, the quality of the development sleeve and the flange is stable and the image quality is improved.

The development sleeve 15*a* is made of a metal such as aluminum or the like. The flange is made of resin such as plastic which is softer than aluminum. Thus, the fitting portion 15*a'* of the development sleeve 15*a* expands by approximately 10 μm. If the press-fitting portion overlaps with a portion contacting the photoconductor drum, of the spacer roll, the clearance between the photoconductor drum and the development roller may vary, or the control of the amount of expansion may be difficult even if the thickness of the contact portion of the spacer roll is thinned with the expectation of the expansion. Thus, the distance between the development roller and the photoconductor drum is not maintained constant.

The present embodiment solves the above problem. In the present embodiment, the axial fitting length of the development sleeve 15*a* and the flange 27 is shorter than the distance from the end of the development sleeve to the position of a portion 29*a* contacting photoconductor drum, of the spacer roll 29, and the fitting portion is located at an axially different position than the spacer roll, specifically externally of the spacer roll. Also, the amount of expansion of the development sleeve 15*a* is designed to be smaller than a difference between the thickness of the contacting portion 29*a* of the spacer roll 29 and the thickness of the other portion (which covers the fitting portion) 29*b*.

The development roller and the photoconductor drum are pulled to each other by the spring 30, so that the adjacent portion to the abutment 29*a* of the spacer roll is flexed and both of the surface of the development sleeve and the surface of the photoconductor drum abut against the contacting portion 29*a* to keep the constant spacing between the development sleeve and the photoconductor drum. Since the amount of expansion of the development sleeve is in the order of several tens μm and the flexure of the spacer roll is very small, the contacting portion of the spacer roll is prevented from being offset.

In the present embodiment, since the spacer roll which contacts the development sleeve and the photoconductor drum is provided more inwardly (toward the center) than the fitting portion of the flange and the development sleeve along the axis of the development sleeve, the expansion of the development sleeve does not affect the contacting portion of the spacer roll even if the diameter of the development sleeve varies by the press-fitting of the flange and the spacing between the development sleeve and the photoconductor drum is always maintained constant.

In the present embodiment, the development sleeve of the development roller 15 is of aluminum and the flange is of plastic, but both materials may be of metal so long as they prevent the detachment and the idle rotation, and the amount of expansion is smaller than the difference between the thickness of the contacting portion of the spacer roll and the thickness of the other portion.

However, it is desirable that the flange is made of a softer material than that of the development sleeve in suppressing the expansion of the development sleeve.

Figure 5A:
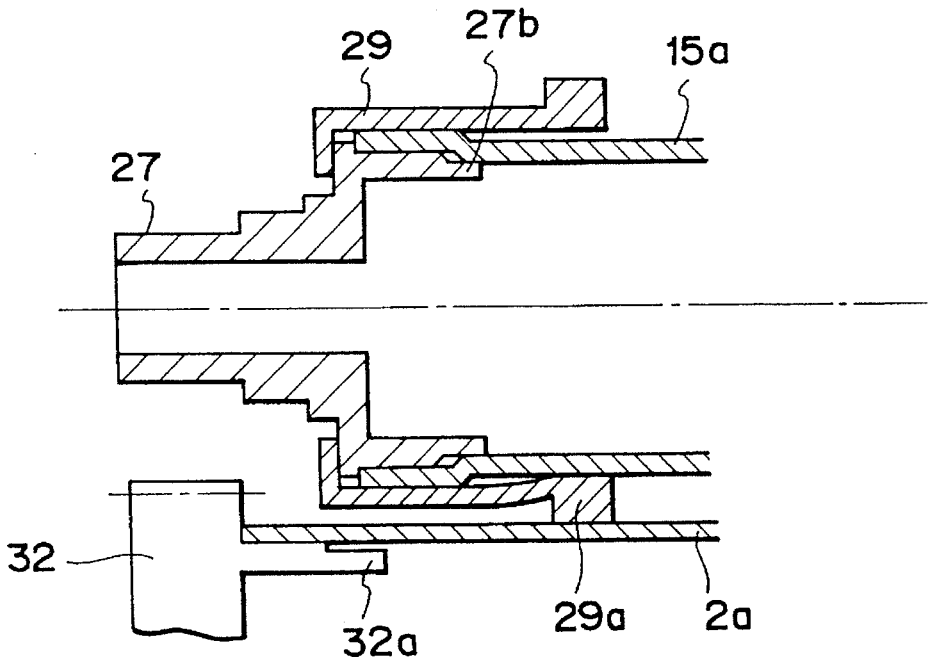
FIGS. 5A and 5B show another embodiment of the present invention.
Figure 5B:
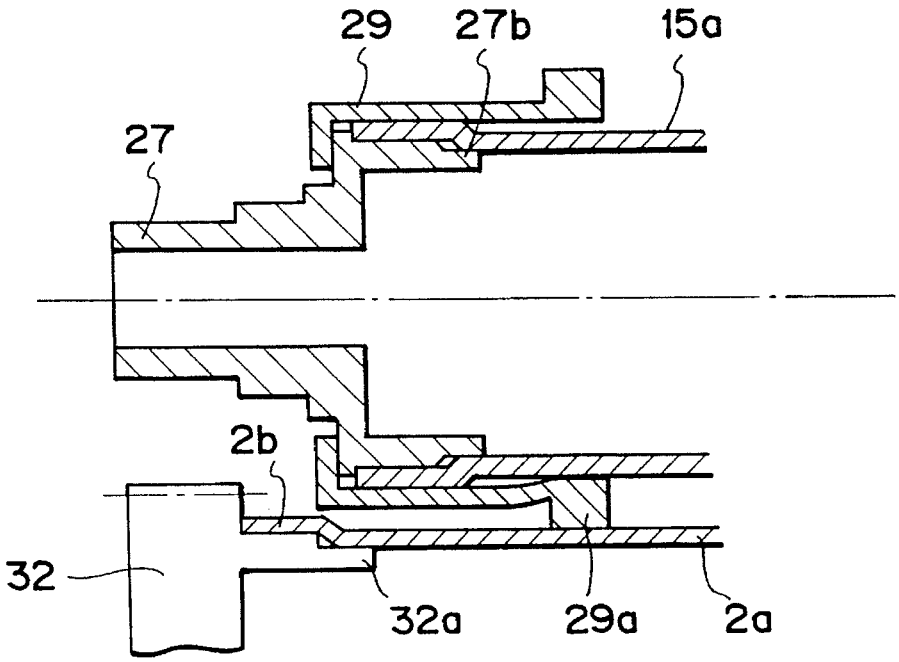

Another embodiment of the present invention is now explained with reference to FIGS. 5A and 5B. The common elements to those of the previous embodiment are designated by the same numerals and the explanation thereof is omitted.

While the development roller has been discussed in the above embodiment, similar means may be applied to the photoconductor drum. In the present embodiment, as shown in FIG. 5A, a guide 32*a* is provided at an end of a photoconductor drum gear flange 32 and it is press-fitted to a photoconductor drum pipe 2*a*. Where the photoconductor drum is expanded by press-fitting as shown in FIG. 5B, it may be designed such that the expansion 2*b* of the pipe comes outwardly of the contacting portion 29*a* of the spacer roll 29. In this manner, the same objects and effects as those of the above embodiment are attained, and stable and firm press-fitting is attained.

Figure 6:
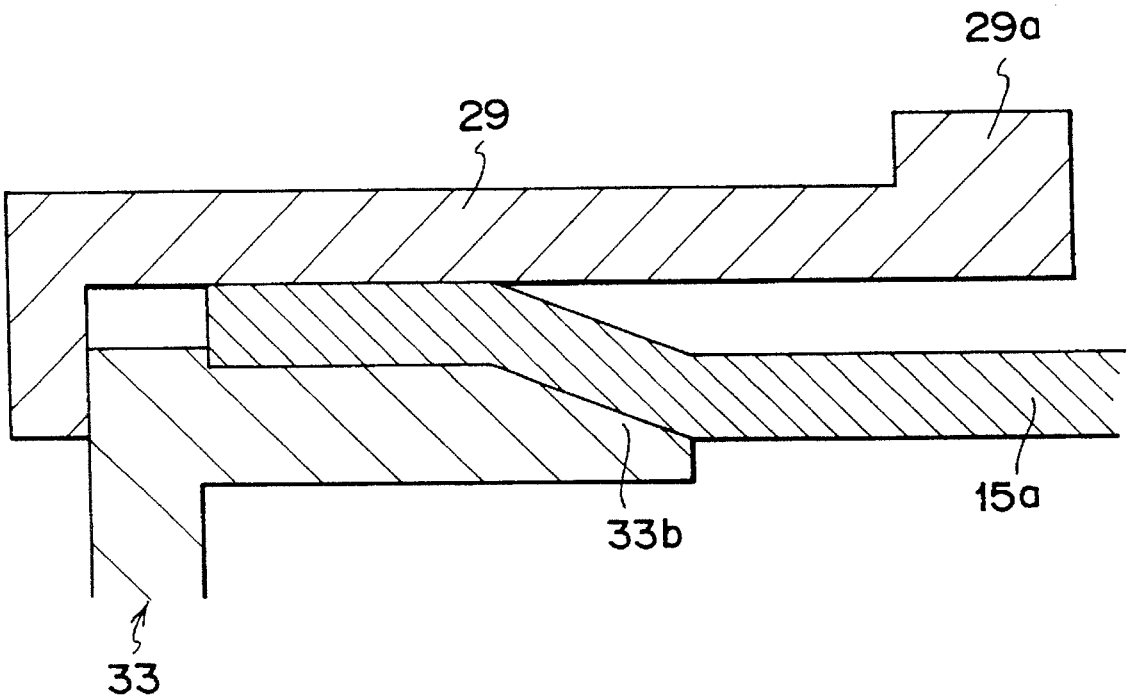
FIG. 6 shows a further embodiment of the present invention.
Figure 7:
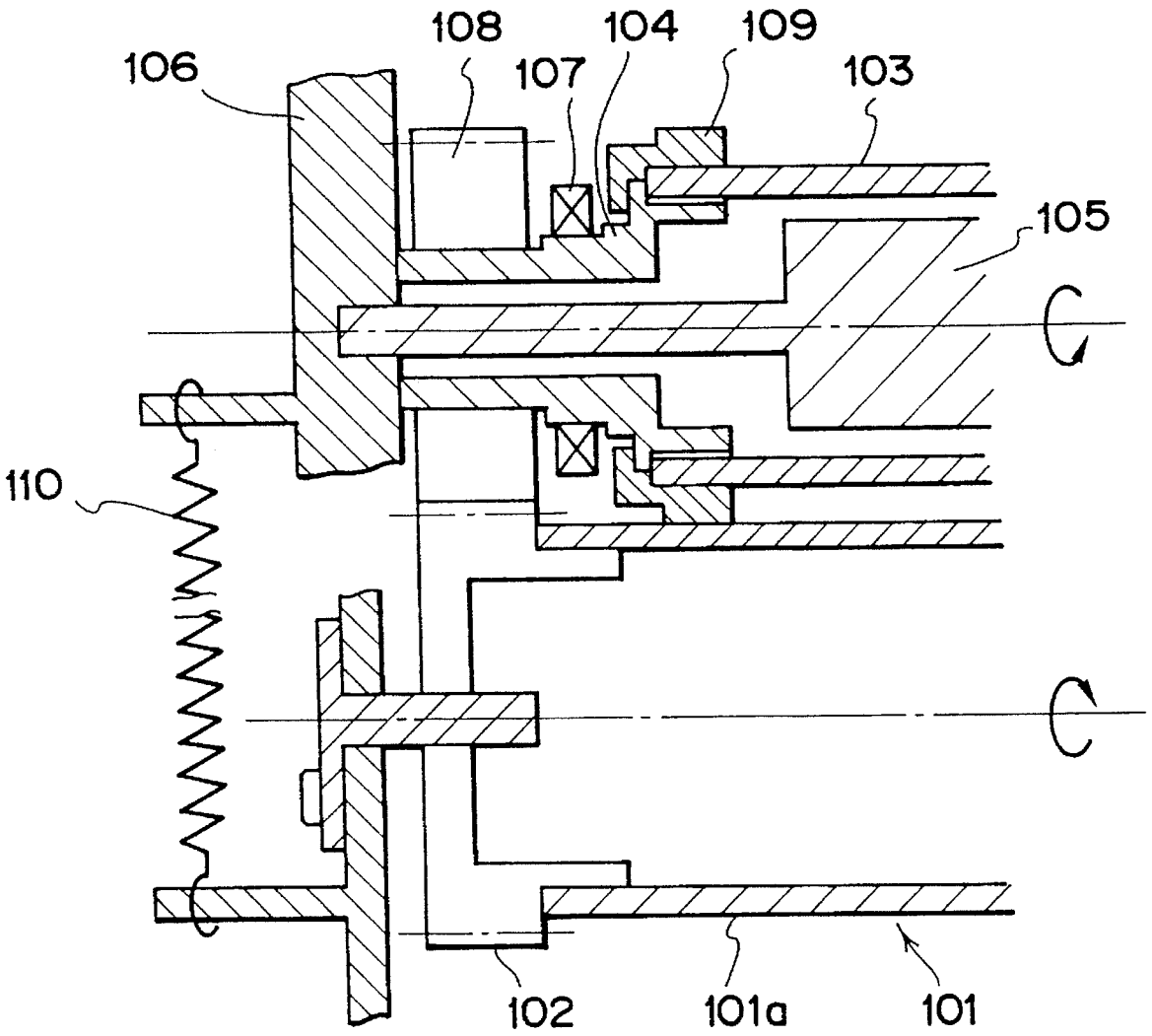
FIG. 7 PRIOR ART
FIG. 7 shows a periphery of the development roller and the photoconductor drum in a conventional apparatus.
Figure 8:
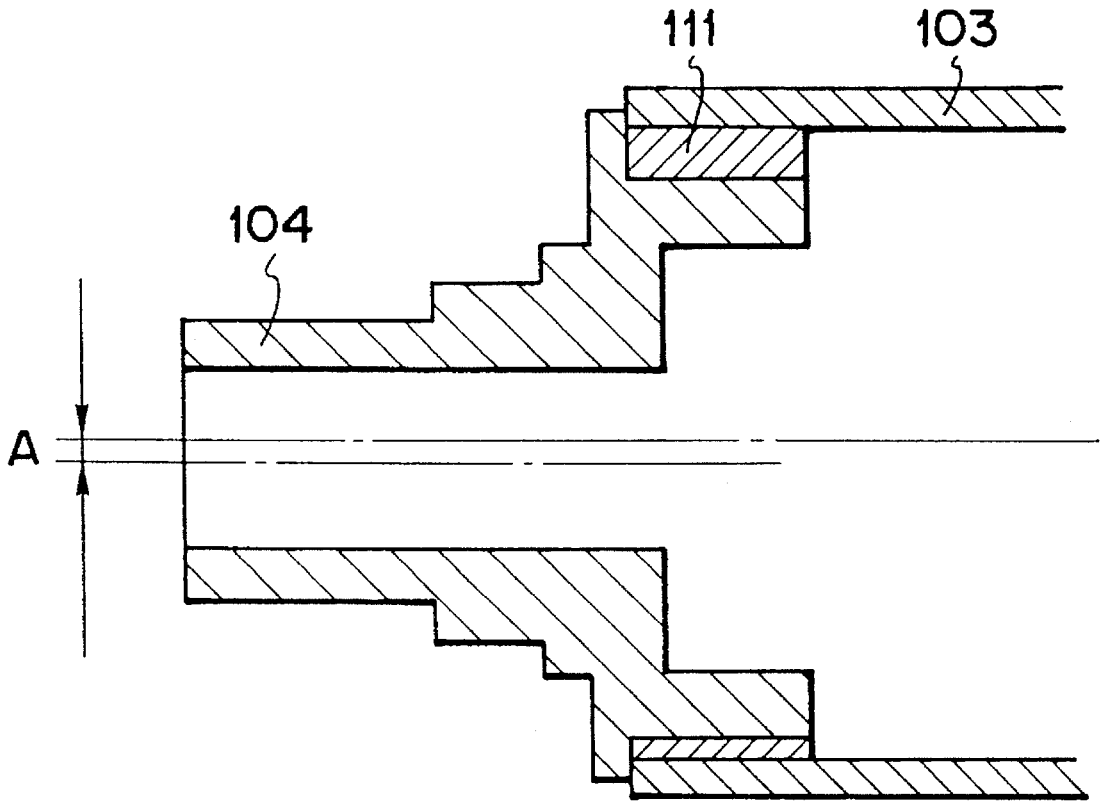
FIG. 8 PRIOR ART
FIG. 8 shows a mounting portion of the development sleeve and the flange in FIG. 7.

A further embodiment of the present invention is explained with reference to FIG. 6. The common elements to those of the previous embodiments are designated by the same numerals and the explanation thereof is omitted.

In the above embodiment, the guide is cylindrical, but in the present embodiment, the guide 33*b* for guiding the fitting is tapered. The tapered guide permits the easy press-fitting as the cylindrical guide does and the same effects as those of the previous embodiment are attained.

In the above embodiments, the photoconductor drum, the development unit and the like are integrally constructed in the process cartridge, but the invention can be applied to such image forming apparatus that the photoconductor drum, the development unit and the like are individually incorporated within the main body thereof.

While the present invention has been described in conjunction with the preferred embodiments, the present invention is not limited to those embodiments but they may be modified or changed without departing from the scope of the present invention.

What is claimed is:

1. A process cartridge removably mountable onto a main body of an image forming apparatus, said process cartridge comprising:

an image carrying member;

a developing agent carrying member for supplying a developing agent to said image carrying member in order to develop a latent image formed on said image carrying member;

a flange provided in an end portion of said developing agent carrying member by being fitted therein, wherein an outer diameter of a fitting portion of said flange to be fitted into said developing agent carrying member is larger than an inner diameter of a fitting portion of said developing agent carrying member to be fitted into said flange before said flange and said developing agent carrying member are fitted to each other, said flange is mounted to said developing agent carrying member by press-fitting, and said flange has a guide portion having an outer diameter smaller than the inner diameter of said developing agent carrying member at an end of said fitting portion, said guide portion being a guide when said flange and said developing agent carrying member are fitted; and a spacer for keeping a constant spacing between said image carrying member and said developing agent carrying member, wherein a contacting position of said spacer with said image carrying member and said developing agent carrying member is located at a more central side of said developing agent carrying member than the fitting portion of said flange press-fitted into said developing agent carrying member in an axial direction of said developing agent carrying member.

2. A process cartridge according to claim 1, wherein said guide portion of said flange has a cylindrical shape.

3. A process cartridge according to claim 1, wherein said guide portion of said flange has a tapered shape.

4. A process cartridge according to claim 1, wherein said spacer has a cap shade made of resin, mounted rotatably to an end of a developing roller as said developing agent carrying member and an end portion of said spacer has an diameter larger than the other portion, said end portion abutting against a curved surface of said image carrying member.

5. A process cartridge according to claim 1, wherein said image carrying member and said developing agent carrying member are biased by a spring so as to approach each other.

6. A process cartridge according to claims 1, 4 or 5, wherein said developing agent carrying member is made of metal, and said flange is made of resin.

7. A process cartridge according to claim 6, wherein said metal is aluminum, and said flange is made of plastic.

8. A process cartridge according to claim 4, wherein the developing roller as said developing agent carrying member is rotated by transmitting a driving force with a gear flange provided in an end of a photosensitive drum as said image carrying member, and to said gear flange, a driving force is transmitted by a driving gear provided in the main body of the image forming apparatus.

9. A process cartridge according to claim 8, wherein said developing roller includes a magnet therein, said flange is rotatably supported in a bearing, and said developing roller is supported by a holder through said magnet and said bearing.

10. A process cartridge removably mountable into a main body of an image forming apparatus, said process cartridge comprising:

a photosensitive member;

a developing roller for supplying a developing agent to said photosensitive member in order to develop a latent image formed on said photosensitive member;

a flange provided in an end portion of said developing roller by being fitted therein, wherein an outer diameter of a fitting portion of said flange to be fitted into said developing roller is larger than an inner diameter of a fitting portion of said developing roller to be fitted into said flange before said flange and said developing roller are fitted to each other, said flange is mounted to said developing roller by press-fitting, said flange has a guide portion having an outer diameter smaller than the inner diameter of said developing roller at an end of said fitting portion, and said guide portion is a guide when said flange and said developing roller are fitted;

a spacer for keeping a constant spacing between said photosensitive member and said developing roller; and a spring for biasing said photosensitive member and said developing roller so as to approach each other, wherein a contacting position of said spacer with said photosensitive member and said developing roller is located at a more central side of said developing roller than the fitting portion of said flange press-fitted into said developing roller in an axial direction of said developing roller.

11. A process cartridge according to claim 10, wherein said guide portion of said flange has a cylindrical shape.

12. A process cartridge according to claim 10, wherein said guide portion of said flange has a tapered shape.

13. A process cartridge according to claim 10, wherein said spacer has a cap shade made of resin, mounted rotatably to an end of said developing roller as a developing agent carrying member and an end portion of said spacer has an outer diameter larger than the other portion, said end portion abutting against a curved surface of said photosensitive member.

14. A process cartridge according to claims 10 or 13, wherein said developing roller is made of metal, and said flange is made of resin.

15. A process cartridge according to claim 14, wherein said metal is aluminum, and said flange is made of plastic.

16. A process cartridge according to claim 13, wherein said developing roller as said developing agent carrying member is rotated by transmitting a driving force with a gear flange provided in an end of said photosensitive drum as an image carrying member, and to said gear flange, a driving force is transmitted by a driving gear provided in the main body of the image forming apparatus.

17. A process cartridge according to claim 16, wherein said developing roller includes a magnet therein, said flange is rotatably supported in a bearing, and said developing roller is supported by a holder through said magnet and said bearing.

18. A process cartridge removably mountable onto a main body of an image forming apparatus, said process cartridge comprising:

a photosensitive drum;

a developing roller made of metal and for supplying a developing agent to said photosensitive drum in order to develop a latent image formed on said photosensitive drum, said developing roller including a magnet therein;

a flange made of resin and provided in an end portion of said developing roller by being fitted therein, wherein an outer diameter of a fitting portion of said flange to be fitted into said developing roller is larger than an inner diameter of a fitting portion of said developing roller to be fitted into said flange before said flange and said developing roller are fitted to each other, said flange is mounted to said developing roller by press-fitting, said flange has a guide portion having an outer diameter smaller than the inner diameter of said developing roller at an end of said fitting portion, and said guide portion is a guide when said flange and said developing roller are fitted;

a spacer made of resin and provided in an end of said developing roller and for keeping a constant spacing between said photosensitive drum and said developing roller; and a spring for biasing said photosensitive drum and said developing roller so as to approach each other, wherein a contacting position of said spacer with said photosensitive drum and said developing roller is located at a more central side of said developing roller than the fitting portion of said flange press-fitted into said developing roller in an axial direction of said developing roller, said developing roller is rotated by transmitting a driving force with a gear flange provided in an end of said photosensitive drum, and to said gear flange, a driving force is transmitted by a driving gear provided in the main body of the image forming apparatus.

19. A process cartridge according to claim 18, wherein said guide portion of said flange has a cylindrical shape.

20. A process cartridge according to claim 18, wherein said guide portion of said flange has a tapered shape.

21. A process cartridge according to claim 18, wherein said spacer has a cap shade made of resin, mounted rotatably to an end of said developing roller and an end portion of said spacer has an outer diameter larger than the other portion, said end portion abutting against a curved surface of said photosensitive drum.

22. A process cartridge according to claims 18 or 21, wherein said developing roller is made of aluminum, and said flange is made of plastic.

23. A process cartridge according to claim 22, wherein said developing roller includes a magnet therein, said flange is rotatably supported in a bearing, and said developing roller is supported by a holder through said magnet and said bearing.

24. A process cartridge removably mountable onto a main body of an image forming apparatus, said process cartridge comprising:

an image carrying member;

a developing agent carrying member for supplying a developing agent to said image carrying member in order to develop a latent image formed on said image carrying member;

a flange provided in an end portion of said image carrying member by being fitted therein, wherein an outer diameter of a fitting portion of said flange to be fitted into said image carrying member is larger than an inner diameter of a fitting portion of said image carrying member to be fitted into said flange before said flange and said image carrying member are fitted to each other, said flange is mounted to said image carrying member by press-fitting, and said flange has a guide portion having an outer diameter smaller than the inner diameter of said image carrying member at an end of said fitting portion, said guide portion being a guide when said flange and said image carrying member are fitted; and a spacer for keeping a constant spacing between said image carrying member and said developing agent carrying member, wherein a contacting position of said spacer with said image carrying member and said developing agent carrying member is located at a more central side of said image carrying member than the fitting portion of said flange press-fitted into said image carrying member in an axial direction of said image carrying member.

25. A process cartridge according to claim 24, wherein said guide portion of said flange has a cylindrical shape.

26. A process cartridge according to claim 24, wherein said guide portion of said flange has a tapered shape.

27. A process cartridge according to claim 24, wherein said spacer has a cap shape made of resin, mounted rotatably to an end of a developing roller as said developing agent carrying member and an end portion of said cap has an outer diameter larger than the other portion, said end portion abutting against a curved surface of said image carrying member.

28. A process cartridge according to claim 24, wherein said image carrying member and said developing agent carrying member are biased by a spring so as to approach each other.

29. A process cartridge according to claims 24, 27 or 28, wherein said developing agent carrying member is made of metal, and said flange is made of resin.

30. A process cartridge according to claim 29, wherein said metal is aluminum, and said flange is made of plastic.

31. A process cartridge according to claim 24, wherein the developing roller as said developing agent carrying member is rotated by transmitting a driving force with a gear flange as said flange, and to said gear flange, a driving force is transmitted by a driving gear provided in the main body of the image forming apparatus.

32. A process cartridge according to claim 31, wherein said developing roller includes a magnet therein, and is rotatably supported in a bearing, and said developing roller is supported by a holder through said magnet and said bearing.

33. A process cartridge removably mountable onto a main body of an image forming apparatus, said process cartridge comprising:

a photosensitive drum;

a developing roller for supplying a developing agent to said photosensitive drum in order to develop a latent image formed on said photosensitive drum;

a flange provided in an end portion of said photosensitive drum by being fitted therein, wherein an outer diameter of a fitting portion of said flange to be fitted into said photosensitive drum is larger than an inner diameter of a fitting portion of said photosensitive drum to be fitted into said flange before said flange and said photosensitive drum are fitted to each other, said flange is mounted to said photosensitive drum by press-fitting, said flange has a guide portion having an outer diameter smaller than the inner diameter of said photosensitive drum at an end of said fitting portion, and said guide portion is a guide when said flange and said photosensitive drum are fitted;

a spacer for keeping a constant spacing between said photosensitive drum and said developing roller; and a spring for biasing said photosensitive drum and said developing roller so as to approach each other, wherein a contacting position of said spacer with said photosensitive drum and said developing roller is located at a more central side of said photosensitive drum than the fitting portion of said flange press-fitted into said photosensitive drum in an axial direction of said photosensitive drum.

34. A process cartridge according to claim 33, wherein said guide portion of said flange has a cylindrical shape.

35. A process cartridge according to claim 33, wherein said guide portion of said flange has a tapered shape.

36. A process cartridge according to claim 33, wherein said spacer has a cap shade made of resin, mounted rotatably to an end of said developing roller as a developing agent carrying member and an end portion of said spacer has an outer diameter larger than the other portion, said end portion abutting against a curved surface of said photosensitive drum.

37. A process cartridge according to claim 36, wherein said developing agent carrying member is made of metal, and said flange is made of resin.

38. A process cartridge according to claim 37, wherein said metal is aluminum, and said flange is made of plastic.

39. A process according claim 38, wherein said developing roller is rotated by transmitting a driving force with a gear flange as said flange, and to said gear flange, a driving force is transmitted by a driving gear provided in the main body of the image forming apparatus.

40. A process cartridge according to claim 39, wherein said developing roller includes a magnet therein, and is rotatably supported in a bearing, and said developing roller is supported by a holder through said magnet and said bearing.

41. A process cartridge removably mountable onto a main body of an image forming apparatus, said process cartridge comprising:

a photosensitive drum;

a developing roller made of metal and for supplying a developing agent to said photosensitive drum in order to develop a latent image formed on said photosensitive drum, said developing roller including a magnet therein;

a gear flange having a gear, made of resin and provided in an end portion of said photosensitive drum by being fitted therein, wherein an outer diameter of a fitting portion of said gear flange to be fitted into said photosensitive drum is larger than an inner diameter of a fitting portion of said photosensitive drum to be fitted into said gear flange before said gear flange and said photosensitive drum are fitted to each other, said gear flange is mounted to said photosensitive drum by press-fitting, said gear flange has a guide portion having an outer diameter smaller than the inner diameter of said photosensitive drum at an end of said fitting portion, and said guide portion is a guide when said gear flange and said photosensitive drum are fitted;

a spacer made of resin and provided in an end of said developing roller and for keeping a constant spacing between said photosensitive drum and said developing roller; and a spring for biasing said photosensitive drum and said developing roller so as to approach each other, wherein a contacting position of said spacer with said photosensitive drum and said developing roller is located at a more central side of said photosensitive drum than the fitting portion of said gear flange press-fitted into said photosensitive drum in an axial direction of said photosensitive drum, said developing roller is rotated by transmitting a driving force with said gear flange, and to said gear flange, a driving force is transmitted by a driving gear provided in the main body of the image forming apparatus.

42. A process cartridge according to claim 41, wherein said guide portion of said flange has a cylindrical shape.

43. A process cartridge according to claim 41, wherein said guide portion of said flange has a tapered shape.

44. A process cartridge according to claim 41, wherein said spacer has a cap shape made of resin, mounted rotatably to an end of said developing roller and an end portion of said spacer has an outer diameter larger than the other portion, said end portion abutting against a curved surface of said photosensitive drum.

45. A process cartridge according to claim 44, wherein said developing roller is made of aluminum, and said gear flange is made of plastic.

46. A process cartridge according to claim 45, wherein said developing roller is rotatably supported in a bearing, and said developing roller is supported by a holder through said magnet and said bearing.

47. A process cartridge according to claims 1, 10, 18, 24, 33 or 41, further comprising charging means.

48. A process cartridge according to claims 1, 10, 18 24, 33 or 41, further comprising cleaning means.

49. An image forming apparatus onto which a process cartridge is removably mountable for forming an image on a recording medium, said apparatus comprising:

a) a mounting unit for mounting the process cartridge removably and mountably, said mounting unit comprising:

an image carrying member;

a developing agent carrying member for supplying a developing agent to said image carrying member in order to develop a latent image formed on said image carrying member;

a flange provided in an end portion of said developing agent carrying member by being fitted therein, wherein an outer diameter of a fitting portion of said flange to be fitted into said developing agent carrying member is larger than an inner diameter of a fitting portion of said developing agent carrying member to be fitted into said flange before said flange and said developing agent carrying member are fitted to each other, said flange is mounted to said developing agent carrying member by press-fitting, and said flange has a guide portion having an outer diameter smaller than the inner diameter of said developing agent carrying member at an end of said fitting portion, said guide portion being a guide when said flange and said developing agent carrying member are fitted; and a spacer for keeping a constant spacing between said image carrying member and said developing agent carrying member, wherein a contacting position of said spacer with said image carrying member and said developing agent carrying member is located at a more central side of said developing agent carrying member than the fitting portion of said flange press-fitted into said developing agent carrying member in an axial direction of said developing agent carrying member;

b) transferring means for transferring to said recording medium a toner image formed on said image carrying member which is included in said process cartridge mounted on said mounting unit;

c) fixing means for fixing in said recording medium the toner image transferred onto said recording medium by said transferring means; and d) feeding means for feeding said recording medium.

50. An image forming apparatus onto which a process cartridge is removably mountable for forming an image on a recording medium, said apparatus comprising:

a) a mounting unit for mounting the process cartridge removably and mountably, said mounting unit comprising:

a photosensitive member;

a developing roller for supplying a developing agent to said photosensitive member in order to develop a latent image formed on said photosensitive member;

a flange provided in an end portion of said developing roller by being fitted therein, wherein an outer diameter of a fitting portion of said flange to be fitted into said developing roller is larger than an inner diameter of a fitting portion of said developing roller to be fitted into said flange before said flange and said developing roller are fitted to each other, said flange is mounted to said developing roller by press-fitting, said flange has a guide portion having an outer diameter smaller than the inner diameter of said developing roller at an end of said fitting portion, and said guide portion is a guide when said flange and said developing roller are fitted;

a spacer for keeping a constant spacing between said photosensitive member and said developing roller; and a spring for biasing said photosensitive member and said developing roller so as to approach each other, wherein a contacting position of said spacer with said photosensitive member and said developing roller is located at a more central side of said developing roller than the fitting portion of said flange press-fitted into said developing roller in an axial direction of said developing roller;

b) transferring means for transferring to said recording medium a toner image formed on said photosensitive member which is included in said process cartridge mounted on said mounting unit;

c) fixing means for fixing to said recording medium the toner image transferred onto said recording medium by said transferring means; and d) feeding means for feeding said recording medium.

51. An image forming apparatus onto which a process cartridge is removably mountable for forming an image on a recording medium, said apparatus comprising:

a) a mounting unit for mounting the process cartridge removably and mountably, said mounting unit comprising:

a photosensitive drum;

a developing roller made of metal and for supplying a developing agent to said photosensitive drum in order to develop a latent image formed on said photosensitive drum, said developing roller including a magnet therein;

a flange made of resin and provided in an end portion of said developing roller by being fitted therein, wherein an outer diameter of a fitting portion of said flange to be fitted into said developing roller is larger than an inner diameter of a fitting portion of said developing roller to be fitted into said flange before said flange and said developing roller are fitted to each other, said flange is mounted to said developing roller by press-fitting, said flange has a guide portion having an outer diameter smaller than the inner diameter of said developing roller at an end of said fitting portion, and said guide portion is a guide when said flange and said developing roller are fitted;

a spacer made of resin and provided in an end of said developing roller and for keeping a constant spacing between said photosensitive drum and said developing roller; and a spring for biasing said photosensitive drum and said developing roller so as to approach each other, wherein a contacting position of said spacer with said photosensitive drum and said developing roller is located at a more central side of said developing roller than the fitting portion of said flange press-fitted into said developing roller in an axial direction of said developing roller, said developing roller is rotated by transmitting a driving force with a gear flange provided in an end of said photosensitive drum, and to said gear flange, a driving force is transmitted by a driving gear provided in the main body of the image forming apparatus;

b) transferring means for transferring to said recording medium a toner image formed on said photosensitive drum which is included in said process cartridge mounted on said mounting unit;

c) fixing means for fixing to said recording medium the toner image transferred onto said recording medium by said transferring means; and d) feeding means for feeding said recording medium.

52. An image forming apparatus onto which a process cartridge is removably mountable for forming an image on a recording medium, said apparatus comprising:

a) a mounting unit for mounting the process cartridge removably and mountably, said mounting unit comprising:

an image carrying member;

a developing agent carrying member for supplying a developing agent to said image carrying member in order to develop a latent image formed on said image carrying member;

a flange provided in an end portion of said image carrying member by being fitted therein, wherein an outer diameter of a fitting portion of said flange to be fitted into said image carrying member is larger than an inner diameter of a fitting portion of said image carrying member to be fitted into said flange before said flange and said image carrying member are fitted to each other, said flange is mounted to said image carrying member by press-fitting, and said flange has a guide portion having an outer diameter smaller than the inner diameter of said image carrying member at an end of said fitting portion of said flange, said guide portion being a guide when said flange and said image carrying member are fitted; and a spacer for keeping a constant spacing between said image carrying member and said developing agent carrying member, wherein a contacting position of said spacer with said image carrying member and said developing agent carrying member is located at a more central side of said image carrying member than the fitting portion of said flange press-fitted into said image carrying member in an axial direction of said image carrying member;

b) transferring means for transferring to said recording medium a toner image formed on said image carrying member which is included in said process cartridge mounted on said mounting unit;

c) fixing means for fixing to said recording medium the toner image transferred onto said recording medium by said transferring means; and d) feeding means for feeding said recording medium.

53. An image forming apparatus onto which a process cartridge is removably mounted for forming an image on a recording medium, said apparatus comprising:

a) a mounting unit for mounting the process cartridge removably and mountably, said mounting unit comprising:

a photosensitive drum;

a developing roller for supplying a developing agent to said photosensitive drum in order to develop a latent image formed on said photosensitive drum;

a flange provided in an end portion of said photosensitive drum by being fitted therein, wherein a fitting portion of said flange fitted into said photosensitive drum has an outer diameter larger than an inner diameter of a fitting portion of said photosensitive drum fitted into said flange, said flange is mounted to said photosensitive drum by press-fitting, said flange has a guide portion having an outer diameter smaller than the inner diameter of said photosensitive drum at an end of said fitting portion, and said guide portion is a guide when said flange and said photosensitive drum are fitted;

a spacer for keeping a constant spacing between said photosensitive drum and said developing roller; and a spring for biasing said photosensitive drum and said developing roller so as to approach each other, wherein a contacting position of said spacer with said photosensitive drum and said developing roller is located at a more central side of said photosensitive drum than the fitting portion of said flange press-fitting into said photosensitive drum in an axial direction of said photosensitive drum;

b) transferring means for transferring to said recording medium a toner image formed on said photosensitive drum which is included in said process cartridge mounted on said mounting unit;

c) fixing means for fixing to said recording medium the toner image transferred onto said recording medium by said transferring means; and d) feeding means for feeding said recording medium.

54. An image forming apparatus onto which a process cartridge is removably mounted for forming an image on a recording medium, said apparatus comprising:

a) a mounting unit for mounting the process cartridge removably and mountably, said mounting unit comprising:

a photosensitive drum;

a developing roller made of metal and for supplying a developing agent to said photosensitive drum in order to develop a latent image formed on said photosensitive drum, said developing roller including a magnet therein;

a gear flange having a gear, made of resin and provided in an end portion of said photosensitive drum by being fitted therein, wherein a fitting portion of said gear flange fitted into said photosensitive drum has an outer diameter larger than an inner diameter of a fitting portion of said photosensitive drum fitted into said gear flange, said gear flange is mounted to said photosensitive drum by press-fitting, said gear flange has a guide portion having an outer diameter smaller than the inner diameter of said photosensitive drum at an end of said fitting portion, and said guide portion is a guide when said gear flange and said photosensitive drum are fitted;

a spacer made of resin and provided in an end of said developing roller and for keeping a constant spacing between said photosensitive drum and said developing roller; and a spring for biasing said photosensitive drum and said developing roller so as to approach each other, wherein a contacting position of said spacer with said photosensitive drum and said developing roller is located at a more central side of said photosensitive drum than the fitting portion of said gear flange press-fitted into said photosensitive drum in an axial direction of said photosensitive drum, said developing roller is rotated by transmitting a driving force with said gear flange, and to said gear flange, a driving force is transmitted by a driving gear provided in the main body of the image forming apparatus;

b) transferring means for transferring to said recording medium a toner image formed on said photosensitive drum which is included in said process cartridge mounted on said mounting unit;

c) fixing means for fixing to said recording medium the toner image transferred onto said recording medium by said transferring means; and d) feeding means for feeding said recording medium.

55. An image forming apparatus according to claims 49, 50, 51, 52, 53 or 54, wherein said image forming apparatus is an electro-photographic copying machine.

56. An image forming apparatus according to claims 49, 50, 51, 52, 53 or 54, wherein said image forming apparatus is a laser beam printer.

* * * * *

UNITED STATES PATENT AND TRADEMARK OFFICE

CERTIFICATE OF CORRECTION

PATENT NO. : 5,579,085

DATED : November 26, 1996

INVENTOR(S): Shigeo Miyabe, et al.

It is certified that error appears in the above-identified patent and that said Letters Patent is hereby corrected as shown below:

On the title page, Item [57], line 8, after "fitting.", delete "A spacer is located at a more central side of the cylinder than the fitting portion of the flange press-fitted into the cylinder."

Col. 1, line 36, after "photoconductor" insert --sleeve--.

Col. 10, line 8, change "cap" to -- spacer --.

Col. 14, line 61, change "mounted" to -- mountable --.

Signed and Sealed this

Twenty-ninth Day of April, 1997

*Attest:*

Bruce Lehman

BRUCE LEHMAN

*Attesting Officer*

*Commissioner of Patents and Trademarks*